US011339952B2

(12) United States Patent
Wang

(10) Patent No.: US 11,339,952 B2
(45) Date of Patent: May 24, 2022

(54) QUICK-ASSEMBLY LIGHT SOURCE MODULE AND LAMP

(71) Applicant: OPPLE LIGHTING CO., LTD., Shanghai (CN)

(72) Inventor: Quanbiao Wang, Shanghai (CN)

(73) Assignee: Opple Lighting Co., Ltd., Shanghai (CN)

( * ) Notice: Subject to any disclaimer, the term of this patent is extended or adjusted under 35 U.S.C. 154(b) by 15 days.

(21) Appl. No.: 16/910,043

(22) Filed: Jun. 23, 2020

(65) Prior Publication Data

US 2020/0318814 A1 Oct. 8, 2020

Related U.S. Application Data

(63) Continuation of application No. PCT/CN2018/123933, filed on Dec. 26, 2018.

(30) Foreign Application Priority Data

Dec. 26, 2017 (CN) ..... 201721846997.8

(51) Int. Cl.
*F21V 17/16* (2006.01)
*F21V 29/77* (2015.01)
(Continued)

(52) U.S. Cl.
CPC ..... *F21V 17/164* (2013.01); *F21V 29/773* (2015.01); *F21V 31/005* (2013.01); *F21Y 2105/10* (2016.08); *F21Y 2115/10* (2016.08)

(58) Field of Classification Search
CPC .... F21V 17/164; F21V 29/773; F21V 31/005; F21Y 2105/10; F21Y 2115/10
See application file for complete search history.

(56) References Cited

U.S. PATENT DOCUMENTS 10,190,746 B1 * 1/2019 Mao ..... F21V 5/04
10,683,971 B2 * 6/2020 Tudorica ..... F21K 9/68
2012/0051056 A1 * 3/2012 Derks ..... F21V 15/01 362/257

FOREIGN PATENT DOCUMENTS

CN 103032744 A 4/2013
CN 103775916 A 5/2014
(Continued)

OTHER PUBLICATIONS

International Search Report of PCT Application No. PCT/CN2018/123933 dated Mar. 12, 2019, (4p).

*Primary Examiner* — Andrew J Coughlin
*Assistant Examiner* — Jessica M Apenteng
(74) *Attorney, Agent, or Firm* — Arch & Lake LLP

(57) ABSTRACT

The present disclosure discloses a quick-assembly light source module, a lighting device and a method of manufacturing a quick-assembly light source module. The quick-assembly light source module includes: an optical portion, a light source board and a circuit board; an edge or a light incident surface of the optical portion is provided with at least two first snap-fit elements, and a side portion of each of the first snap-fit elements is provided with a circuit board slot; the circuit board is provided with a first snap-fit hole; the first snap-fit element is inserted into the first snap-fit hole, and the circuit board is clamped into the circuit board slot, the light source board is disposed between the optical portion and the circuit board, and a surface of the light source board facing towards the light incident surface of the optical portion is provided with a light source.

19 Claims, 3 Drawing Sheets

(51) Int. Cl.

| | |
|---|---|
| ***F21V 31/00*** | (2006.01) |
| ***F21Y 105/10*** | (2016.01) |
| ***F21Y 115/10*** | (2016.01) |

(56) References Cited

FOREIGN PATENT DOCUMENTS

| | | | |
|---|---|---|---|
| CN | 205299415 | U | 6/2016 |
| CN | 205560329 | U | 9/2016 |
| CN | 207635030 | U | 7/2018 |

* cited by examiner

QUICK-ASSEMBLY LIGHT SOURCE MODULE AND LAMP

TECHNICAL FIELD

This application is based upon and claims the priority of PCT patent application No. PCT/CN2018/123933 filed on Dec. 26, 2018 which claims priority to the Chinese patent application No. 201711432035.2 filed on Dec. 26, 2017 and the Chinese patent application No. 201721846997.8 filed on Dec. 26, 2017, the entire content of all of which is hereby incorporated by reference herein for all purposes.

TECHNICAL FIELD

The present disclosure relates to the field of lighting technology, and particularly relates to a quick-assembly light source module and a lighting device.

BACKGROUND

Light source module is an important constituent part of a lighting device. The light source module may include an electrical portion and an optical portion, in which the electrical portion may include a circuit board and a light source board.

SUMMARY

The present disclosure provides a quick-assembly light source module, a lighting device and a method of manufacturing a quick-assembly light source module.

According to a first aspect, a quick-assembly light source module is provided. The quick-assembly light source module may include: an optical portion, a light source board and a circuit board; an edge or a light incident surface of the optical portion is provided with at least two first snap-fit elements which are arranged along a circumferential direction of the optical portion and are protruded towards an orientated direction of the light incident surface, a side portion of each of the first snap-fit elements is provided with a circuit board slot which is inwardly concaved from an external surface of the first snap-fit element; the circuit board is provided with a first snap-fit hole; the first snap-fit element is inserted into the first snap-fit hole, and the circuit board is clamped into the circuit board slot, the light source board is disposed between the optical portion and the circuit board, and a surface of the light source board facing towards the light incident surface of the optical portion is provided with a light source.

According to another aspect, a lighting device is provided. The light device may include a quick-assembly light source module which may include an optical portion, a light source board and a circuit board. An edge or a light incident surface of the optical portion may be provided with at least two first snap-fit elements which may be arranged along a circumferential direction of the optical portion and may be protruded towards an orientated direction of the light incident surface, a side portion of each of the first snap-fit elements may be provided with a circuit board slot which may be inwardly concaved from an external surface of the first snap-fit element.

Also, the circuit board may be provided with a first snap-fit hole; the first snap-fit element may be inserted into the first snap-fit hole, and the circuit board may be clamped into the circuit board slot, the light source board may be disposed between the optical portion and the circuit board, and a surface of the light source board facing towards the light incident surface of the optical portion may be provided with a light source.

According a further aspect, a method of a method of manufacturing a quick-assembly light source module is provided. The method may include providing an optical portion, a light source board and a circuit board; providing an edge or a light incident surface of the optical portion with at least two first snap-fit elements; arranging the at least two first snap-fit elements along a circumferential direction of the optical portion, where the at least two first snap-fit elements may be protruded towards an orientated direction of the light incident surface; providing a side portion of each of the first snap-fit elements with a circuit board slot which is inwardly concaved from an external surface of the first snap-fit element; providing the circuit board with a first snap-fit hole; inserting the first snap-fit element into the first snap-fit hole, and clamping the circuit board into the circuit board slot; and disposing the light source board between the optical portion and the circuit board, and providing a surface of the light source board facing towards the light incident surface of the optical portion with a light source.

It is to be understood that both the foregoing general description and the following detailed description are exemplary and explanatory only and are not restrictive of the present disclosure.

BRIEF DESCRIPTION OF THE DRAWINGS

The accompanying drawings here are incorporated into the specification and constitute a part of this specification. The accompanying drawings illustrate examples of the present disclosure, and serve to explain the principles of the present disclosure together with the description.

DETAILED DESCRIPTION

Examples of the present disclosure are described in more details in conjunction with drawings and examples. The examples below are for the purpose of explaining the present disclosure without limiting the cope thereof.

The terminology used in the present disclosure is for the purpose of describing exemplary examples only and is not intended to limit the present disclosure. As used in the present disclosure and the appended claims, the singular forms "a," "an" and "the" are intended to include the plural forms as well, unless the context clearly indicates otherwise. It shall also be understood that the terms "or" and "and/or" used herein are intended to signify and include any or all possible combinations of one or more of the associated listed items, unless the context clearly indicates otherwise.

It shall be understood that, although the terms "first," "second," "third," and the like may be used herein to describe various information, the information should not be limited by these terms. These terms are only used to distinguish one category of information from another. For example, without departing from the scope of the present disclosure, first information may be termed as second information; and similarly, second information may also be termed as first information. As used herein, the term "if" may be understood to mean "when" or "upon" or "in response to" depending on the context.

The numerals referred in present disclosure are:

100—optical portion; 101—first snap-fit element; 102—second snap-fit element; 103—lug boss; 104—mounting via; 105—guiding slope; 106—circuit board pressing piece; 1001—light incident surface; 1002—light exiting surface; 1011—circuit board slot;

200—light source board; 201—light source; 202—column reserved recess;

300—circuit board; 301—integral hole; 302—optical portion fool-proof hole; 301*a*-first snap-fit hole; 301*b*-heat dissipation hole; 303—cable trough; 400—electrical box; 500—lamp body; 600—power line; 700—front ring; 800—dustproof cover; 900—reflector.

The assembling method of a light source module may include: firstly, attaching a heat dissipation surface of the light source board onto the circuit board, then fixing the light source board with the circuit board by using a screw, then mounting the optical portion on the circuit board through a screw and covering the optical portion at an external side of the light source board. The assembling process of the light source module may involve complicated operations, large number of process steps and long working hours.

At the same time, the heat dissipation surface of the light source board may be attached onto the circuit board, resulting in poor heat dissipation performance. For high-power light source modules, inadequate capability of heat dissipation may easily lead to a damage of a light-emitting diode (LED) in the light source board.

Figure 1:
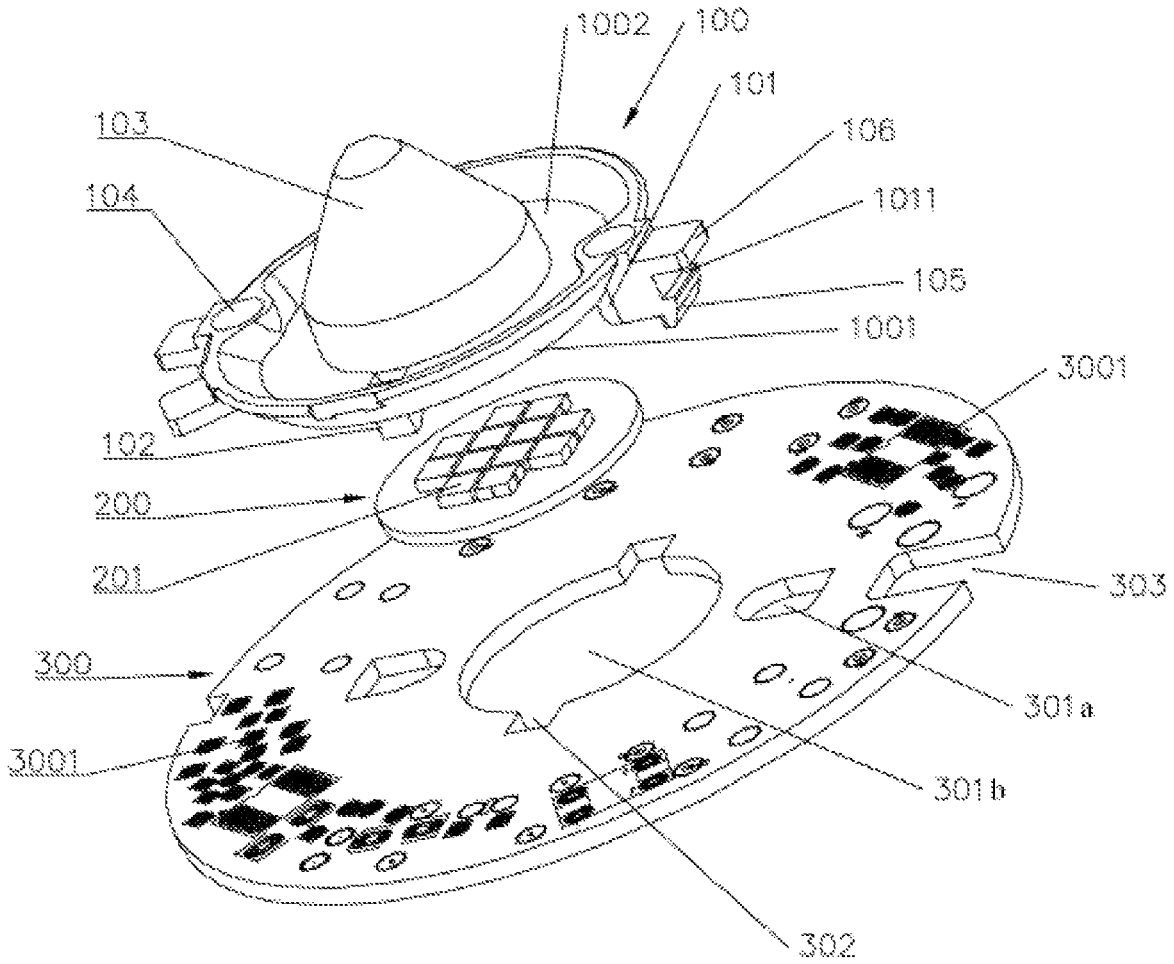
FIG. 1 is an exploded view in accordance with an example of a quick-assembly light source module of the present disclosure.

As one of examples of the present disclosure, referring to FIG. 1, the present disclosure discloses a quick-assembly light source module, including an optical portion 100, a light source board 200 and a circuit board 300. The circuit board 300 is provided with electrical elements 3001 such as circuit, light source driver and wiring terminal. An edge of the optical portion 100 is provided with at least two first snap-fit elements 101 which are arranged along a circumferential direction of the optical portion 100 and are protruded towards an orientated direction of the light incident surface 1001; the first snap-fit element 101 is arranged to have an angle with respect to the light incident surface 1001 of the optical portion 100.

As illustrated in FIG. 1, in the present example, the first snap-fit element 101 is disposed at the edge of the optical portion 100, and is arranged to have an angle of 90° with respect to the light incident surface 1001 of the optical portion 100; the number of the first snap-fit element 101 is set as two, and two first snap-fit elements 101 are arranged at an angle of 180° in the circumferential direction of the optical portion 100. In another example, the first snap-fit element 101 is arranged to be protruded from the light incident surface 1001 of the optical portion 100 towards the orientated direction of the light incident surface 1001; the first snap-fit element 101 may be arranged to be protruded from an edge of the light incident surface 1001 of the optical portion 100 towards the orientated direction of the light incident surface 1001.

A side portion of the first snap-fit element 101 is provided with a circuit board slot 1011 which is concaved internally from an external surface of the first snap-fit element 101, the circuit board slot 1011 is used for connecting with the circuit board 300 in a clamped manner, so as to clamp the circuit board 300 into the circuit board slot 1011. The circuit board 300 is provided with a first snap-fit hole 301*a*, the first snap-fit hole 301*a* is used for allowing the first snap-fit element 101 to pass there-through and for allowing the circuit board 300 to be connected with the circuit board slot 1011 of the first snap-fit element 101 in a clamped manner. As illustrated in FIG. 1, the circuit board 300, the light source board 200 and the optical portion 100 are sequentially disposed; the first snap-fit element 101 is inserted into the first snap-fit hole 301*a* and the circuit board 300 is clamped into the circuit board slot 1011; the light source board 200 is disposed between the light incident surface 1001 of the optical portion 100 and the circuit board 300; a surface of the light source board 200 facing towards the optical portion 100 is provided with a light source 201, the light source 201 may be a LED light source.

As illustrated in FIG. 1, in the present example, the light source board 200 may be made by adopting a ceramic material, and the light source 201 is disposed at a middle portion of the light source board 200. As illustrated in FIG. 1, the circuit board 300, the light source board 200 and the optical portion 100 are disposed sequentially from bottom to up; the light source 201 of the light source board 200 faces upwards; the first snap-fit element 101 of the optical portion 100 is inserted into the first snap-fit hole 301*a*; the circuit board slot 1011 is connected with the circuit board 300 in a clamped manner, that is, the first snap-fit element 101 and an edge of the first snap-fit hole 301*a* are snap-fitted with each other so that the light source board 200 is clamped between the light incident surface 1001 of the optical portion 100 and the circuit board 300; the circuit board 300, the light source board 200 and the optical portion 100 constitute a light source module having an integral structure; then a circuit between the light source 201 and the electrical element of the circuit board 300 is electrically conducted by a power line so as to finish the assembling of the light source module. After the light source module is powered, light emitted by the light source 201 of the light source board 200 is incident into the light incident surface 1001 of the optical portion 100, and exits from a light exiting surface 1002 of the optical portion 100 upon being processed by a light path of the optical portion 100.

Figure 2:
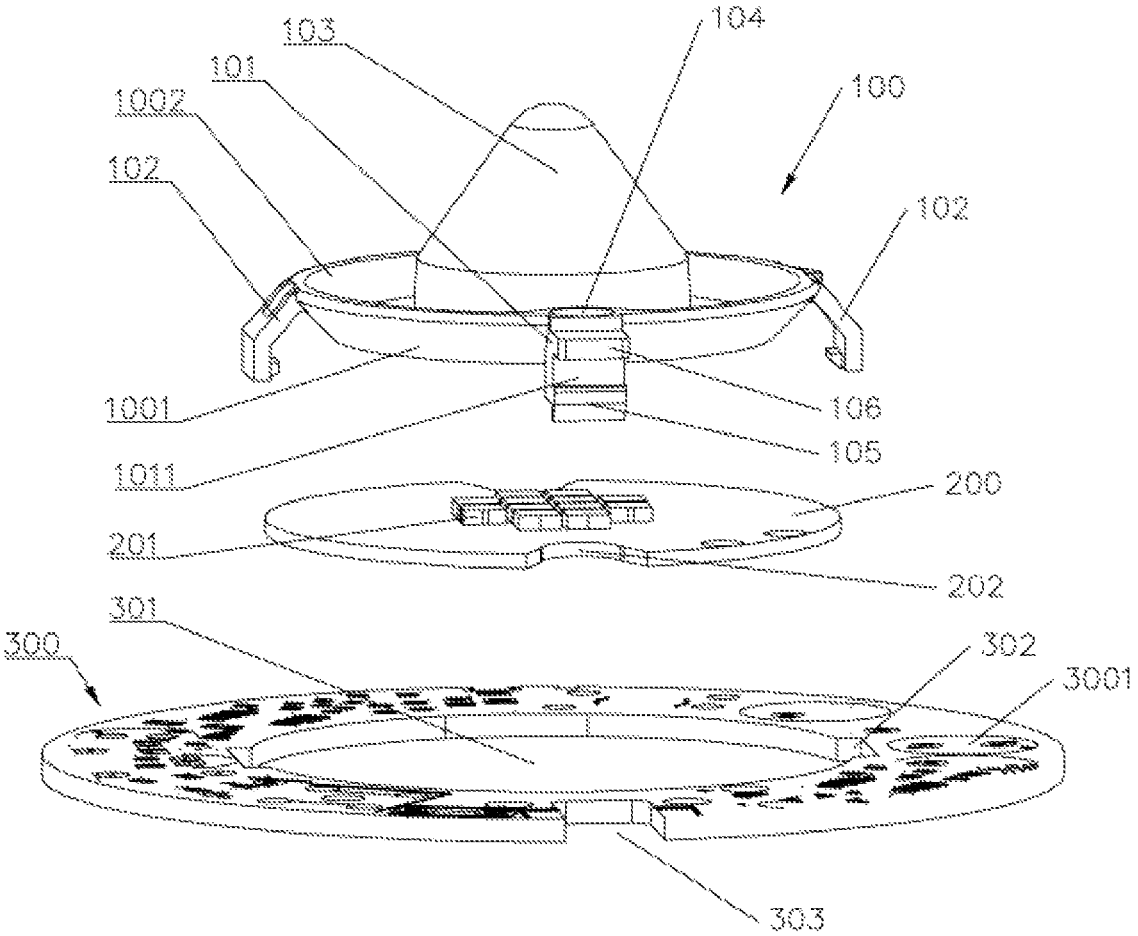
FIG. 2 is another exploded view in accordance with an example of a quick-assembly light source module of the present disclosure.

The number of the light source 201 may be one or more; when a plurality of light sources 201 is provided, the plurality of light sources 201 are arranged in an array or arranged in an annular shape. As illustrated in FIG. 2, in the present example, the plurality of light sources 201 are arranged in an array. It should be noted that, the term "orientated direction of light incident surface" as used in the present disclosure refers to a direction from the light incident surface to the outside, that is, as illustrated in FIG. 1, the light incident surface is arranged to face downwards, and the orientated direction of the light incident surface is a downward direction.

In an assembling process of the quick-assembly light source module of the present disclosure, the light source board 200 is placed on the circuit board 300, the first snap-fit element 101 of the optical portion 100 is inserted into the first snap-fit hole 301*a* along a direction from top to bottom, the first snap-fit element 101 is subject to a deformation when inserted into the first snap-fit hole 301*a* and forms a snap-fitted structure with the circuit board slot 1011 upon being inserted to a certain position so as to clamp the light source board 200 between the light incident surface 1001 of the optical portion 100 and the circuit board 300, that is, the circuit board 300, the light source board 200 and the optical portion 100 constitute a light source module having an integral structure. The quick-assembly light source module of the present disclosure has advantages of simple assembling operation, small number of process steps and short working hours, thereby improving the working efficiency of production line workers.

As one solution, in the present example, the circuit board 300 is provided with a heat dissipation hole 301*b* which corresponds to the light source board 200. Generally, the light source 201 is disposed at a middle portion of the light source board 200, and the heat dissipation hole 301*b* is arranged to correspond to a position of the light source 201. Heat generated by the light source 201 when it emits light is dissipated through the heat dissipation hole 301*b*, thereby improving the heat dissipation capacity of the light source module and reducing the risk of damaging the light source due to overheat; therefore, it's applicable to manufacture higher-power light source modules.

As one solution, referring to FIG. 1, in the present example, the light incident surface 1001 of the optical portion 100 is further provided with a plurality of second snap-fit elements 102, the plurality of second snap-fit elements 102 are arranged along a circumferential direction of the optical portion 100 and are protruded towards an orientated direction of the light incident surface 1001. The plurality of second snap-fit elements 102, together, clamp the light source board 200 so as to locate the light source board 200 in a clamped manner. As illustrated in FIG. 2, in the present example, the number of the second snap-fit element 102 is set as two, these two second snap-fit elements 102 are arranged along the circumferential direction at an angle of 180°, and each of the second snap-fit elements 102 slightly extends outwardly from the light incident surface 1001 of the optical portion 100. A connecting line of the two second snap-fit elements 102 is arranged to be perpendicular to a connecting line of the two first snap-fit elements 101. In the assembling process, the light source board 200 is placed on the circuit board 300, the optical portion 100 is heavily pressed, and when the first snap-fit element 101 is inserted into the first snap-fit hole 301*a*, the light source board 200 overcomes an elastic force of the second snap-fit element 102 to be embedded into a space enclosed by the second snap-fit element 102 and is clamped and fixed by the second snap-fit element 102.

Alternatively, in the assembling process, firstly, the light source board 200 is pressed into the space enclosed by the second snap-fit element 102, and then the first snap-fit element 101 is inserted into the first snap-fit hole 301*a*. The second snap-fit element 102 clamps the light source board 200 so that the light source board 200 in the light source module structure is more stable and reliable, thereby reducing the risk of damaging the light source 201 of the light source board 200. Further, in order to clamp and locate the light source board 200 in a better way, a side portion of the second snap-fit element 102 is provided with a light source board slot (not illustrated in the figures) which is concaved inwardly from an external surface of the second snap-fit element 102.

As one solution, the circuit board 300 is provided with an optical portion fool-proof hole 302 which allows the second snap-fit element 102 to pass there-through. After assembling, the second snap-fit element 102 is inserted into the optical portion fool-proof hole 302 so as to locate the optical portion 100 and prevent from misoperation.

Further, as illustrated in FIG. 1, an end of the first snap-fit element 101 away from the light incident surface 1001 of the optical portion 100 is provided with a guiding slope 105. The first snap-fit element 101 is protruded and extending, outwardly, from the edge of the optical portion 100, and the end of the first snap-fit element 101 away from the light incident surface 1001 of the optical portion 100 is a free end for inserting into the first snap-fit hole 301*a*; by providing the guiding slope 105 at the free end of the first snap-fit hole 301*a*, it facilitates guiding the first snap-fit element 101 into the first snap-fit hole 301*a* during mounting.

Further, as illustrated in FIG. 1, an external side portion of the first snap-fit element 101 is provided with a circuit board pressing piece 106, the circuit board pressing piece 106 is disposed between the circuit board slot 1011 and the optical portion 100, and the arrangement of the circuit board pressing piece 106 realizes a limiting function which prevents the light incident surface 1001 of the optical portion 100 from compressing the light source 201 of the light source board 200 during the assembling process, thereby preventing the light source from damage and ensuring the yield.

Further, as illustrated in FIG. 1, the first snap-fit element 101 is provided with a mounting via 104, the mounting via 104 is concaved from a light exiting surface 1002 of the optical portion 100 towards the light incident surface 1001 of the optical portion 100 and penetrates the first snap-fit element 101. When mounting the light source module at a lamp bracket of a lighting device, a screw is used to pass through the mounting via 104 from the light exiting surface 1002 of the optical portion 100 to be connected to the lamp bracket, so as to form a stable connecting structure.

Further, as illustrated in FIG. 1, the light exiting surface 1002 of the optical portion 100 is provided with a lug boss 103. The lug boss 103 serves for converging light and scattering light, so that the light emitted by the light source can achieve the effect required by users through light propagation in the optical portion 100.

Further, as illustrated in FIG. 1, an edge of the circuit board 300 is provided with a cable trough 303. The cable trough 303 is a U-shaped trough opened from the edge of the circuit board 300 and is used for receiving the power line.

In the example above, both the number of the first snap-fit element 101 and the number of the second snap-fit element 102 are set as two. It should be explained that, the number of the first snap-fit element 101 and the number of the second snap-fit element 102 may also be set as three, four and six. Generally, the example adopting three first snap-fit elements 101 and three second snap-fit elements 102 provides the mostly stable structure. For light source module having high requirements for product quality and higher power, the number of the first snap-fit element 101 and the number of the second snap-fit element 102 may be set as three, and the first snap-fit elements 101 and the second snap-fit elements 102 may be uniformly arranged along the circumferential direction of the light incident surface 1001 of the optical portion 100.

In the example above, the heat dissipation hole and the first snap-fit hole are provided separately, which needs to process a plurality of holes in the circuit board to be used as the heat dissipation hole and the first snap-fit hole, respectively. As another example, the present example is substantially the same with the example above, with the difference as below.

As illustrated in FIG. 2, in the present example, the circuit board 300 is provided with an integral hole 301 which is used as both the heat dissipation hole and the first snap-fit hole. It should be explained that, in the present example, the integral hole has a substantially round shape; in other examples, the integral hole may also be a polygonal hole or an irregular hole. In the present example, the heat dissipation hole and the first snap-fit hole are connected to form an integral hole 301. The heat dissipation hole and the first snap-fit hole constitute an integral hole 301, the integral hole 301 has a large area, so that most area of the light source board 200 directly contacts the air, thereby increasing the heat dissipating area and improving the heat dissipating effect. The circuit board slot 1011 is disposed at an external side of the first snap-fit element 101, and the first snap-fit element 101 is cooperated with an edge of the integral hole 301 to form a snap-fitted connection.

Further, in the present example, as illustrated in FIG. 2, the second snap-fit element 102 is protruded from the edge of the optical portion 100 to the orientated direction of the light incident surface of the optical portion 100, and is slightly extending, outwardly, in an inclined manner to present a substantially L shape. An inner side of the second snap-fit element 102 is further provided with a limiting projection. An optical portion fool-proof hole 302 is formed at the edge of the integral hole 301 and is concaved from inward to outward.

Further, in the present example, both the light source board 200 and the integral hole 301 have a round shape, a diameter of the light source board 200 is greater than a diameter of the integral hole 301, a column reserved recess 202 is formed to be concaved inwardly from the edge of the light source board 200 and allows the first snap-fit element 101 to pass there-through, that is, the edge of the light source board 200 is provided with a U-shaped recess which allows the first snap-fit element 101 to pass there-through. In the assembling process, the operator in the production line can quickly find a correct position for assembling so as to quickly finish the assembling process.

In the present example, an integral hole 301 is provided, and the integral hole 301 is formed by removing a portion of the circuit board 300 located between the heat dissipation hole and the first snap-fit hole, so that the machining work of the circuit board 300 is relatively easy, and the production efficiency can be improved. The light source board 200 is provided with a column reserved recess 202 which on one hand serves for preventing from misoperation, and on the other hand serves for locating so as to prevent the light source board 200 from shifting. Because an integral hole is adopted, a degree of freedom of a relative rotation between the optical portion 100 and the circuit board 300 is unrestricted; the circuit board 300 is provided with an optical portion fool-proof hole 302, and the second snap-fit element 102 is inserted into the optical portion fool-proof hole 302, which on one hand serves for preventing from misoperation and on the other hand serves for locating.

The present disclosure further discloses a lighting device, the lighting device includes the quick-assembly light source module described in the examples above. Those skilled in the art should be appreciated that, the lighting device is also required to include an electrical box, a reflector, a dustproof cover or the like.

Figure 3:
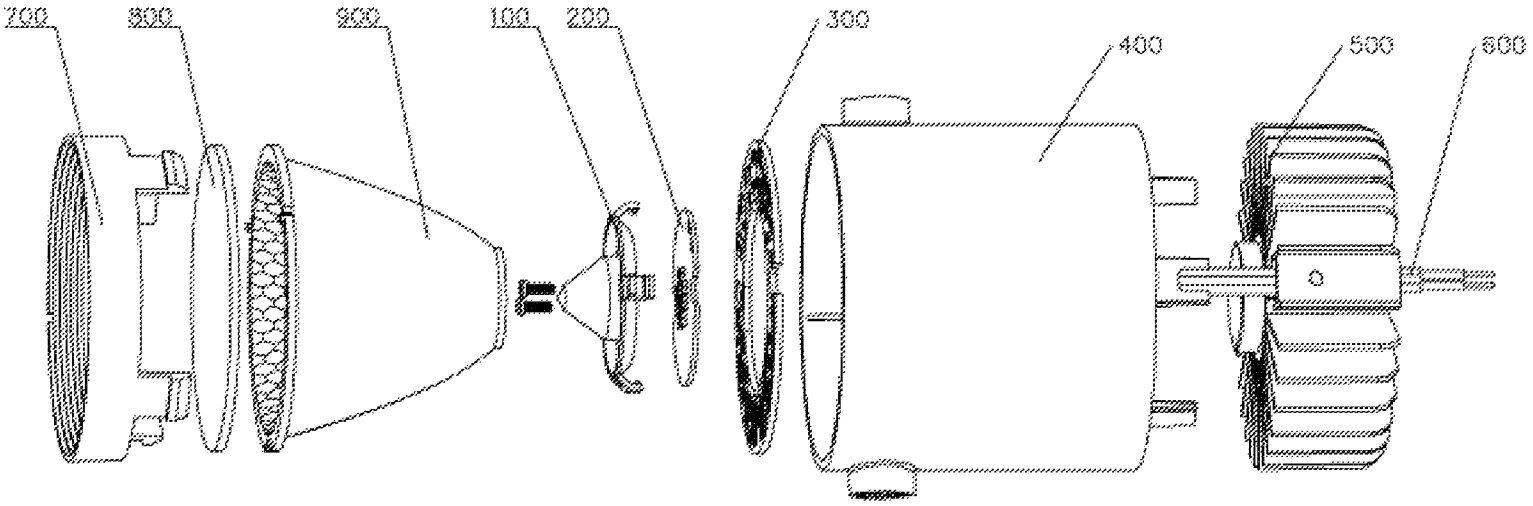
FIG. 3 is an exploded view in accordance with an example of a lighting device of the present disclosure.

In order to clearly describe the lighting device, as illustrated in FIG. 3, the present document describes an example in accordance with the lighting device of the present disclosure, including an optical portion 100, a light source board 200, a circuit board 300, an electrical box 400, a lamp body 500, a power line 600, a front ring 700, a dustproof cover 800 and a reflector 900, among which the optical portion 100, the light source board 200 and the circuit board 300 are assembled into the above-described quick-assembly light source module, the lamp body 500 is placed inside the electrical box 400, the quick-assembly light source module is placed inside the electrical box 400 from a front end of the electrical box 400 and is mounted on the lamp body 500 through a screw, the power line 600 connects the quick-assembly light source module to an external power source, the reflector 900 is embedded into the electrical box 400 from the front end of the electrical box 400, and the dustproof cover 800 is mounted at the front end of the electrical box 400 through the front ring 700 so as to close the interior of the electrical box 400. In other examples, the lighting device is not limited to a downlight, and may also be a stage light, a spot light or the like.

The present disclosure provides a quick-assembly light source module.

A quick-assembly light source module may include: an optical portion, a light source board and a circuit board; an edge or a light incident surface of the optical portion is provided with at least two first snap-fit elements which are arranged along a circumferential direction of the optical portion and are protruded towards an orientated direction of the light incident surface, a side portion of each of the first snap-fit elements is provided with a circuit board slot which is inwardly concaved from an external surface of the first snap-fit element; the circuit board is provided with a first snap-fit hole; the first snap-fit element is inserted into the first snap-fit hole, and the circuit board is clamped into the circuit board slot, the light source board is disposed between the optical portion and the circuit board, and a surface of the light source board facing towards the light incident surface of the optical portion is provided with a light source.

The circuit board may be provided with a heat dissipation hole, and the heat dissipation hole may correspond to the light source board.

The edge or the light incident surface of the optical portion may be further provided with a plurality of second snap-fit elements, the plurality of second snap-fit elements may be arranged along the circumferential direction of the optical portion and may be protruded towards the orientated direction of the light incident surface.

The circuit board may be provided with an optical portion fool-proof hole which allows the second snap-fit element to pass there-through.

A side portion of the second snap-fit element may be provided with a light source board slot which may be inwardly concaved from an external surface of the second snap-fit element.

The heat dissipation hole and the first snap-fit hole may be connected to form an integral hole, the circuit board slot may be disposed at an external side portion of the first snap-fit element.

The light source board and the integral hole may both have a round shape, a diameter of the light source board may be greater than a diameter of the integral hole, the light source board may be provided with a column reserved recess which may be inwardly concaved from an edge of the light source board, the column reserved recess may allow the first snap-fit element to pass there-through.

The external side portion of the first snap-fit element may be provided with a circuit board pressing piece which may be outwardly protruded, the circuit board pressing piece may be located between the circuit board slot and the optical portion.

An end of the first snap-fit element away from the light incident surface may be provided with a guiding slope.

The first snap-fit element may be provided with a mounting via, the mounting via may be concaved from a light exiting surface of the optical portion towards the light incident surface of the optical portion and may penetrate the first snap-fit element.

A light exiting surface of the optical portion may be provided with a lug boss.

An edge of the circuit board may be provided with a cable trough.

The present disclosure also provides a lighting device. The lighting device may include a quick-assembly light source module which may include an optical portion, a light source board and a circuit board. An edge or a light incident surface of the optical portion may be provided with at least two first snap-fit elements which may be arranged along a circumferential direction of the optical portion and may be protruded towards an orientated direction of the light incident surface, a side portion of each of the first snap-fit elements may be provided with a circuit board slot which may be inwardly concaved from an external surface of the first snap-fit element.

The circuit board may be provided with a first snap-fit hole; the first snap-fit element may be inserted into the first snap-fit hole, and the circuit board may be clamped into the circuit board slot, the light source board may be disposed between the optical portion and the circuit board, and a surface of the light source board facing towards the light incident surface of the optical portion may be provided with a light source.

In the lighting device, the circuit board may be provided with a heat dissipation hole, and the heat dissipation hole may correspond to the light source board.

In the lighting device, the edge or the light incident surface of the optical portion may be further provided with a plurality of second snap-fit elements, the plurality of second snap-fit elements may be arranged along the circumferential direction of the optical portion and may be protruded towards the orientated direction of the light incident surface.

In the lighting device, the circuit board may be provided with an optical portion fool-proof hole which allows the second snap-fit element to pass there-through.

The present disclosure also provides a method of manufacturing a quick-assembly light source module. The method may include providing an optical portion, a light source board and a circuit board; providing an edge or a light incident surface of the optical portion with at least two first snap-fit elements; arranging the at least two first snap-fit elements along a circumferential direction of the optical portion, where the at least two first snap-fit elements may be protruded towards an orientated direction of the light incident surface; providing a side portion of each of the first snap-fit elements with a circuit board slot which is inwardly concaved from an external surface of the first snap-fit element; providing the circuit board with a first snap-fit hole; inserting the first snap-fit element into the first snap-fit hole, and clamping the circuit board into the circuit board slot; and disposing the light source board between the optical portion and the circuit board, and providing a surface of the light source board facing towards the light incident surface of the optical portion with a light source.

The method may also include providing the circuit board with a heat dissipation hole, and wherein the heat dissipation hole corresponds to the light source board.

The method may include providing the edge or the light incident surface of the optical portion with a plurality of second snap-fit elements, where the plurality of second snap-fit elements may be arranged along the circumferential direction of the optical portion and may be protruded towards the orientated direction of the light incident surface.

The method may also include providing the circuit board with an optical portion fool-proof hole which allows the second snap-fit element to pass there-through.

As compared with the other implementations, the present disclosure possesses advantages as below.

The quick-assembly light source module of the present disclosure possesses advantages of simple assembling operation, small number of process steps and short working hours, and can improve the working efficiency of the production line workers.

The quick-assembly light source module of the present disclosure is provided with a heat dissipation hole and has good heat dissipation capacity, thereby reducing the risk of damaging the light source due to overheat and allowing for the manufacture of higher-power light source modules.

The present disclosure may include dedicated hardware implementations such as application specific integrated circuits, programmable logic arrays and other hardware devices. The hardware implementations can be constructed to implement one or more of the methods described herein. Examples that may include the apparatus and systems of various implementations can broadly include a variety of electronic and computing systems. One or more examples described herein may implement functions using two or more specific interconnected hardware modules or devices with related control and data signals that can be communicated between and through the modules, or as portions of an application-specific integrated circuit. Accordingly, the system disclosed may encompass software, firmware, and hardware implementations. The terms "module," "sub-module," "circuit," "sub-circuit," "circuitry," "sub-circuitry," "unit," or "sub-unit" may include memory (shared, dedicated, or group) that stores code or instructions that can be executed by one or more processors. The module refers herein may include one or more circuit with or without stored code or instructions. The module or circuit may include one or more components that are connected.

It should be noted that, the examples of the present disclosure contain examples which are not limitative of the present disclosure in any form; any of those skilled familiar with the related arts can make variations and modifications by using the above disclosure to obtain equivalent and effective examples; any contents that are not departing from the technical solutions of the present disclosure, and any changes or equivalent variations and modifications to the above examples in accordance with the technical essences of the present disclosure, are all still fallen within the scopes of technical solutions of the present disclosure.

What is claimed is:

1. A quick-assembly light source module, comprising: an optical portion, a light source board and a circuit board, wherein:

an edge or a light incident surface of the optical portion is provided with at least two first snap-fit elements which are arranged along a circumferential direction of the optical portion and are protruded towards an orientated direction of the light incident surface, a side portion of each of the first snap-fit elements is provided with a circuit board slot which is inwardly concaved from an external surface of the first snap-fit element, wherein the edge or the light incident surface of the optical portion is further provided with a plurality of second snap-fit elements, and wherein a side portion of the second snap-fit element is provided with a light source board slot which is inwardly concaved from an external surface of the second snap-fit element;

the circuit board is provided with a first snap-fit hole;

the first snap-fit element is inserted into the first snap-fit hole, and the circuit board is clamped into the circuit board slot, the light source board is disposed between the optical portion and the circuit board, and a surface of the light source board facing towards the light incident surface of the optical portion is provided with a light source.

2. The quick-assembly light source module according to claim 1, wherein the circuit board is provided with a heat dissipation hole, and the heat dissipation hole corresponds to the light source board.

3. The quick-assembly light source module according to claim 2, wherein the plurality of second snap-fit elements are arranged along the circumferential direction of the optical portion and are protruded towards the orientated direction of the light incident surface.

4. The quick-assembly light source module according to claim 3, wherein the circuit board is provided with an optical portion fool-proof hole which allows the second snap-fit element to pass there-through.

5. The quick-assembly light source module according to claim 2, wherein the heat dissipation hole and the first snap-fit hole are connected to form an integral hole, and the circuit board slot is disposed at an external side portion of the first snap-fit element.

6. The quick-assembly light source module according to claim 5, wherein:

the light source board and the integral hole both have a round shape, a diameter of the light source board is greater than a diameter of the integral hole, and the light source board is provided with a column reserved recess which is inwardly concaved from an edge of the light source board, and the column reserved recess allows the first snap-fit element to pass there-through.

7. The quick-assembly light source module according to claim 5, wherein the external side portion of the first snap-fit element is provided with a circuit board pressing piece which is outwardly protruded, and the circuit board pressing piece is located between the circuit board slot and the optical portion.

8. The quick-assembly light source module according to claim 1, wherein an end of the first snap-fit element away from the light incident surface is provided with a guiding slope.

9. The quick-assembly light source module according to claim 1, wherein the first snap-fit element is provided with a mounting via, and the mounting via is concaved from a light exiting surface of the optical portion towards the light incident surface of the optical portion and penetrates the first snap-fit element.

10. The quick-assembly light source module according to claim 1, wherein a light exiting surface of the optical portion is provided with a lug boss.

11. The quick-assembly light source module according to claim 1, wherein an edge of the circuit board is provided with a cable trough.

12. A lighting device, comprising a quick-assembly light source module which comprises an optical portion, a light source board and a circuit board, wherein:

an edge or a light incident surface of the optical portion is provided with at least two first snap-fit elements which are arranged along a circumferential direction of the optical portion and are protruded towards an orientated direction of the light incident surface, a side portion of each of the first snap-fit elements is provided with a circuit board slot which is inwardly concaved from an external surface of the first snap-fit element, wherein the edge or the light incident surface of the optical portion is further provided with a plurality of second snap-fit elements, and wherein a side portion of the second snap-fit element is provided with a light source board slot which is inwardly concaved from an external surface of the second snap-fit element;

the circuit board is provided with a first snap-fit hole;

the first snap-fit element is inserted into the first snap-fit hole, and the circuit board is clamped into the circuit board slot, the light source board is disposed between the optical portion and the circuit board, and a surface of the light source board facing towards the light incident surface of the optical portion is provided with a light source.

13. The lighting device according to claim 12, wherein the circuit board is provided with a heat dissipation hole, and the heat dissipation hole corresponds to the light source board.

14. The lighting device according to claim 13, wherein the plurality of second snap-fit elements are arranged along the circumferential direction of the optical portion and are protruded towards the orientated direction of the light incident surface.

15. The lighting device according to claim 14, wherein the circuit board is provided with an optical portion fool-proof hole which allows the second snap-fit element to pass there-through.

16. A method of manufacturing a quick-assembly light source module, comprising:

providing an optical portion, a light source board and a circuit board;

providing an edge or a light incident surface of the optical portion with at least two first snap-fit elements, wherein the edge or the light incident surface of the optical portion is further provided with a plurality of second snap-fit elements, and wherein a side portion of the second snap-fit element is provided with a light source board slot which is inwardly concaved from an external surface of the second snap-fit element;

arranging the at least two first snap-fit elements along a circumferential direction of the optical portion, wherein the at least two first snap-fit elements are protruded towards an orientated direction of the light incident surface;

providing a side portion of each of the first snap-fit elements with a circuit board slot which is inwardly concaved from an external surface of the first snap-fit element;

providing the circuit board with a first snap-fit hole;

inserting the first snap-fit element into the first snap-fit hole, and clamping the circuit board into the circuit board slot; and disposing the light source board between the optical portion and the circuit board, and providing a surface of the light source board facing towards the light incident surface of the optical portion with a light source.

17. The method according to claim 16, further comprising:

providing the circuit board with a heat dissipation hole, and wherein the heat dissipation hole corresponds to the light source board.

18. The method according to claim 17, wherein the plurality of second snap-fit elements are arranged along the circumferential direction of the optical portion and are protruded towards the orientated direction of the light incident surface.

19. The method according to claim 18, further comprising:

providing the circuit board with an optical portion fool-proof hole which allows the second snap-fit element to pass there-through.

* * * * *